US008836964B2

(12) United States Patent
Boston et al.

(10) Patent No.: US 8,836,964 B2
(45) Date of Patent: Sep. 16, 2014

(54) QUEUED ERROR RECONCILIATION IN A DOCUMENT PROCESSING ENVIRONMENT

(75) Inventors: Michael G. Boston, Kitchener (CA); Mark G. Paul, Raleigh, NC (US)

(73) Assignee: Bell and Howell, LLC, Durham, NC (US)

( * ) Notice: Subject to any disclaimer, the term of this patent is extended or adjusted under 35 U.S.C. 154(b) by 1199 days.

(21) Appl. No.: 11/342,569

(22) Filed: Jan. 31, 2006

(65) Prior Publication Data

US 2007/0177184 A1 Aug. 2, 2007

(51) Int. Cl.

| | |
|---|---|
| ***G06K 15/00*** | (2006.01) |
| ***B43M 3/04*** | (2006.01) |
| ***B65H 43/00*** | (2006.01) |

(52) U.S. Cl.

CPC ..... *B43M 3/045* (2013.01); *B65H 2301/533* (2013.01); *B65H 2801/78* (2013.01); *B65H 2551/20* (2013.01); *B65H 2511/52* (2013.01); *B65H 2513/51* (2013.01); *B65H 43/00* (2013.01)

USPC ..... 358/1.14

(58) Field of Classification Search

USPC ..... 358/1.14, 1.15

See application file for complete search history.

(56) References Cited

U.S. PATENT DOCUMENTS

| | | | | |
|---|---|---|---|---|
| 5,003,538 | A * | 3/1991 | Lee et al. | 714/748 |
| 5,175,735 | A * | 12/1992 | Dahlby et al. | 714/2 |
| 5,200,958 | A | 4/1993 | Hamilton et al. | |
| 5,550,997 | A * | 8/1996 | Ip et al. | 711/103 |
| 6,353,899 | B1 | 3/2002 | Martin et al. | |
| 6,817,792 | B2 * | 11/2004 | Parry | 400/74 |
| 7,186,040 | B2 * | 3/2007 | Gunther | 400/103 |
| 2002/0171864 | A1 * | 11/2002 | Sesek | 358/1.15 |
| 2003/0112452 | A1 * | 6/2003 | McIntyre | 358/1.1 |
| 2004/0046970 | A1 * | 3/2004 | Miyachi | 358/1.1 |
| 2004/0190019 | A1 * | 9/2004 | Li et al. | 358/1.9 |
| 2006/0039015 | A1 * | 2/2006 | Kageyama et al. | 358/1.5 |

FOREIGN PATENT DOCUMENTS

JP 09-030092 2/1997

OTHER PUBLICATIONS

European Search Report issued in European Patent Application No. EP 07000131.8 dated Oct. 6, 2010.

* cited by examiner

*Primary Examiner* — Jeremiah Bryar

(74) *Attorney, Agent, or Firm* — McDermott Will & Emery LLP

(57) ABSTRACT

The present subject matter relates to a method and system for increasing the throughput of mail processing machines by limiting the number of document processing system stops while effectively allowing errors to be reconciled during the continued operation of the system. More particularly, the present approach involves logging detected errors during an ongoing document processing run. The detected errors are analyzed for priority, and the operator is alerted to take corrective action during run time for specified errors. The reported errors may be reconciled prior to the completion of the document processing run.

18 Claims, 12 Drawing Sheets

QUEUED ERROR RECONCILIATION IN A DOCUMENT PROCESSING ENVIRONMENT

FIELD OF THE INVENTION

The subject matter presented herein relates to a method and system for enabling errors that occur during the execution of a document processing system to be handled without stopping the system.

BACKGROUND

Document processing facilities often use document processing systems such as inserters to assemble and insert mail into envelopes, sorters to sort mail and other high speed document processing equipment. The speed of such equipment is generally measured by the number of mail pieces that can be produced during a given time or job run. Hence, to maximize the efficiency of the document processing system during a job run, it is vital that any errors be minimized if not completely eliminated. Typical errors that may occur during a job run may include a sequence number error, document spoilage (e.g., document bent, wrinkled, or torn) and other such errors that relate to the specific processing requirements and needs of the user of the document processing system. For addressing these errors, two commonplace reconciliation methodologies—real-time error reconciliation and post-job error reconciliation—are often employed.

The first methodology, real-time error reconciliation, results in complete cessation of a job run upon the detection of an error. So, for instance, if a sequence error is detected during the job run, the system is completely stopped until the problem is rectified by the operator of the inserter. The benefit to this methodology is that all errors must be handled in order for the job run to be fully completed; no further error resolutions need be performed at the end of a job run. However, this benefit is outweighed by the obvious fact that the more errors that occur during a particular job run, the more inefficient the machine. This inefficiency problem is magnified even further for very high-speed inserters, where one or more incremental periods of machine stoppage translate into incredible reductions in machine productivity. Moreover, the constant halting of high-speed electromechanical systems such as an inserter can lead to further complications (short-term or long-term) such as paper jams, lubrication issues, mechanical failures and other breakdowns common to devices subject to constant stop-and-go conditions.

Post job error reconciliation, unlike real-time reconciliation allows for the partial completion of a job run (assuming no machine stop errors were invoked). The job run is partial because as long as there are errors detected with various mail pieces, the integrity of the job run cannot be assumed, and is therefore not complete. In post job reconciliation, a log file of errors is maintained as they occur during the job run and made available to the operator after the processing of the last mail piece. The operator then utilizes the error log to determine which pieces are in error and require reconciliation. So, in the case of a missing piece or a sequence error, the operator can then identify what occurred with the missing pieces, whether they were hand stuffed, diverted to another production line, etc.

While post-job error reconciliation can make for somewhat better machine efficiency, the mail job cannot be released until all of the error pieces have been resolved. One can imagine how troubling this can be for a mail production facility, particularly in situations where a particular job must be completed and placed in the mail according to a specific deadline. With post job error reconciliation, the task of reconciling that was performed throughout the real-time reconciliation process is now deferred to the backend. As a further complication, because the errors are not addressed until the end of a job run, errors capable of affecting the integrity of all other mail pieces cannot be detected early on (e.g., when improper indicia being applied to one mail piece affects all subsequent mail pieces). This could potentially result in entire mail production runs having to be redone—negatively impacting both work and cost efficiency.

In FIGS. 1 and 2, prior art means of reconciling errors as they occur during the execution of a job run are shown. Specifically, FIG. 1 illustrates the process of real-time error reconciliation, wherein errors are required to be handled as they occur. According to this arrangement, error settings and/or event settings are established by the operator of the document processing system (step 302). Such settings act as triggers which indicate to the document processing system the types of errors or tolerances (e.g., error or event sensitivity levels) it should recognize during the job run. When the document processing system has documents still requiring production (event 304), the documents are processed (event 306) as long as no errors (event 308) corresponding to the one or more error or event settings established during event 302 are detected. As a job run is executed, production run data (e.g., mail piece, mail count, corresponding sequence number, etc.) may be saved to a log file throughout the execution of the job run (event 310) for subsequent report generation or inspection by the operator.

In instances where errors are detected during the execution of the system (event 312), real-time error reconciliation calls for the document processing system to be completely stopped (event 314). As such, no further processing of documents or mail pieces may commence. When this occurs, the error requiring reconciliation is presented to the operator (event 316) along with various options that the operator may employ to reconcile the error (event 318). The errors may be ascertained by the operator in various ways such as by perusal of the production run log data, or by means of a graphical user interface presented by a control computer system 124 operating in connection with the document processing system 100. Likewise, the reconciliation options may also be determined by the operator manually (e.g., inspection of an error log) or by means of a graphical user interface. Regardless of how the error and reconciliation information is presented and/or determined, the job run is not restarted until the error is handled (event 320). Obviously, such a process can become quite daunting and time consuming as greater numbers of errors occur. Numerous situations, such as the removal of a mailpiece due to jam damage, can result in a sequence error being detected shortly after the machine is restart, resulting in yet another stoppage. Ultimately, an increased number of machine stops diminishes the efficiency and throughput capacity of the system.

FIG. 2 illustrates the process of post-job error reconciliation. As in real-time error reconciliation, error and/or event settings are established (event 402) to allow the document processing system to perceive errors and detect events requiring reconciliation. The document processing system is executed as usual for as long as there are mail pieces requiring processing (events 404 and 406). Unlike real-time error reconciliation, when an error is detected according to the post-job error reconciliation process (event 408), the document processing system is not stopped. The errors may optionally be recorded to a log file for subsequent review by the operator of the document processing system (event 410). When the last mail piece of the job run is processed, any erroneous mail pieces requiring reconciliation are presented to the operator (event 412) along with any reconciliation options (event 414). Once the errors are reconciled (event 416), this signifies the completion of the job run.

The error correction process for the post-job error reconciliation process is deferred until the last mail piece for the production run is processed as opposed to errors being handled as they occur. While this process may increase the overall work efficiency of the system, cost efficiency could be compromised due to the cumulative effects of erroneous mail pieces affecting the integrity of the entire mail run. Most of the mail produced during the job must be staged in the production area since corrects to the mail trays will be required.

To address these issues, a need has arisen to increase the throughput of mail processing machines by limiting the number of document processing system stops while effectively allowing errors to be reconciled during the continued operation of the system.

SUMMARY

The teachings herein alleviate one or more of the above noted problems with a method for logging detected errors during run time, analyzing the errors for priority, stopping the machine in severe situations, alerting the operator to take corrective action during run time for non-critical errors and reconciling the reported errors prior to job completion.

In accord with the present concepts disclosed herein, there is provided a method for reconciling one or more errors that occur during execution of a job run by a document processing system. The method involves recording instances of the one or more errors to a list throughout execution of the job run. The list is presented during the execution of the job run. The method also involves presenting one or more reconciliation options in connection with the one or more errors. One or more reconciliation options may be executable during execution of the job run.

It is also desirable to provide a system for reconciling one or more errors that occur during execution of a job run by a document processing system. The system includes a detection device for detecting one or more errors and a log for recording the one or more errors. The system further includes a graphical user interface for presenting the one or more errors during execution of the job run. The graphical user interface also presents one or more reconciliation options related to the one or more errors, with at least one reconciliation option being executable without any stoppage of the document processing system.

Also disclosed is a process for reconciling errors during execution of a document processing system. The process involves detecting an error as it occurs during the execution of a job run and evaluating the error against a configuration setting. The occurrence of the error is indicated during the execution of the job run, which may enable the error to be reconciled without any stoppage of the document processing system.

In accord with the present concepts disclosed herein, there is also provided a method for prioritizing errors to be reconciled during a job run. The method includes establishing a predetermined range for a tolerance setting and associating a tolerance setting of a specific value within the predetermined range with one or more errors to indicate a level of priority of the one or more errors. A list of the one or more errors that occur during the execution of the job run, while a document process system is running, is presented along with the associated tolerance setting.

Also disclosed is a method for stopping a document processing system, the method includes establishing a constraint setting associated with one or more errors and detecting the occurrence of the constraint setting. The document processing system is stopped based upon the constraint setting.

Additional advantages and aspects of the present subject matter will become readily apparent to those skilled in the art from the following detailed description, wherein embodiments of the present subject matter are shown and described, simply by way of illustration of the best mode contemplated for practicing the present subject matter. As will be described, the present subject matter is capable of other and different embodiments, and its several details are susceptible of modification in various obvious respects, all without departing from the spirit of the present subject matter. Accordingly, the drawings and description are to be regarded as illustrative in nature, and not limitative.

BRIEF DESCRIPTION OF THE DRAWINGS

The following detailed description of the embodiments of the present subject matter can best be understood when read in conjunction with the following drawings, in which the various features are not necessarily drawn to scale but rather are drawn as to best illustrate the pertinent features, and in which like reference numerals are employed throughout to designate similar features.

DETAILED DESCRIPTION

The exemplary concepts presented herein pertain to a method and system for the effective reconciliation of errors that may occur during a mail run in execution by a document processing system. As described herein, a job run or mail run refers to any period of time of execution of a document processing system that is required to process a plurality of documents of any type, but particularly those which may ultimately be designated as mail pieces. Tasks performed during the job run may include, but are not limited to the assembly, folding, inserting, and printing of human or machine readable data to a mail piece. Also, as used herein, address components refer to any human or machine readable data indicated on a mail piece that may be used for directing mail from an originating source to a destination point. Commonly used address components for directing mail to a destination may include the recipient's name or entity name, street name, P.O. Box number, building name, postage or indicia marking, numerical ZIP, City, State, etc. In addition address components may include information that is not readily human readable, such as two-dimensional barcode information, POSTNET, 4-STATE, and PLANET barcode information. Indeed, address components may include a combination of human-readable and machine-readable information for conveying address information for a mail piece. Additional components are printed on the envelope, in the vicinity of the address, which are used in mail processing. Examples may include, but are not limited to, a sequence number, key line weight data and mail handling endorsements. The mail processing equipment may have error detection systems, such as imaging analysis equipment, to recognize errors in any of the critical components printed on the mail.

Figure 1:
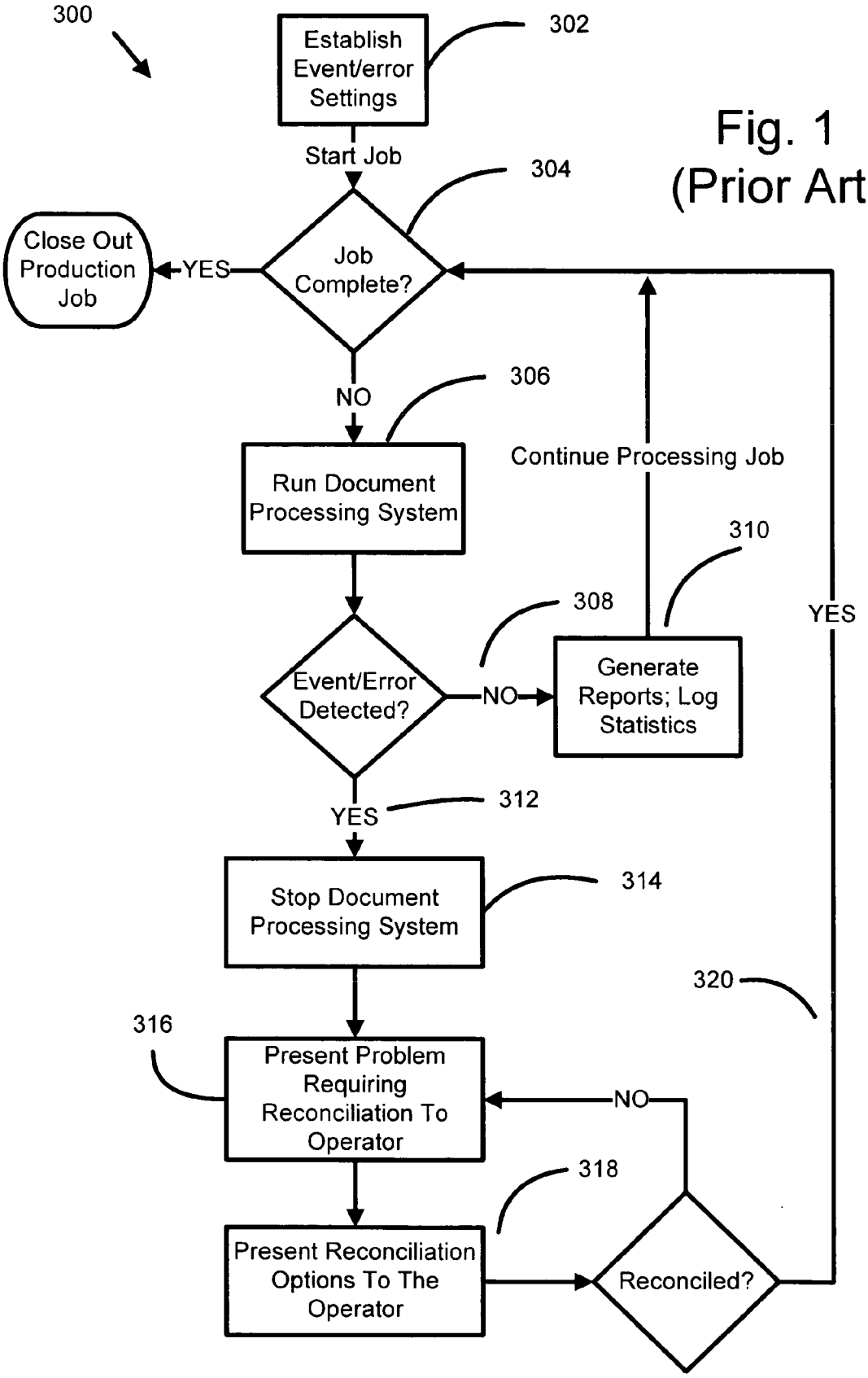
Fig. 1 (Prior Art)
FIG. 1 is a flowchart which illustrates a conventional real-time reconciliation process.
Figure 2:
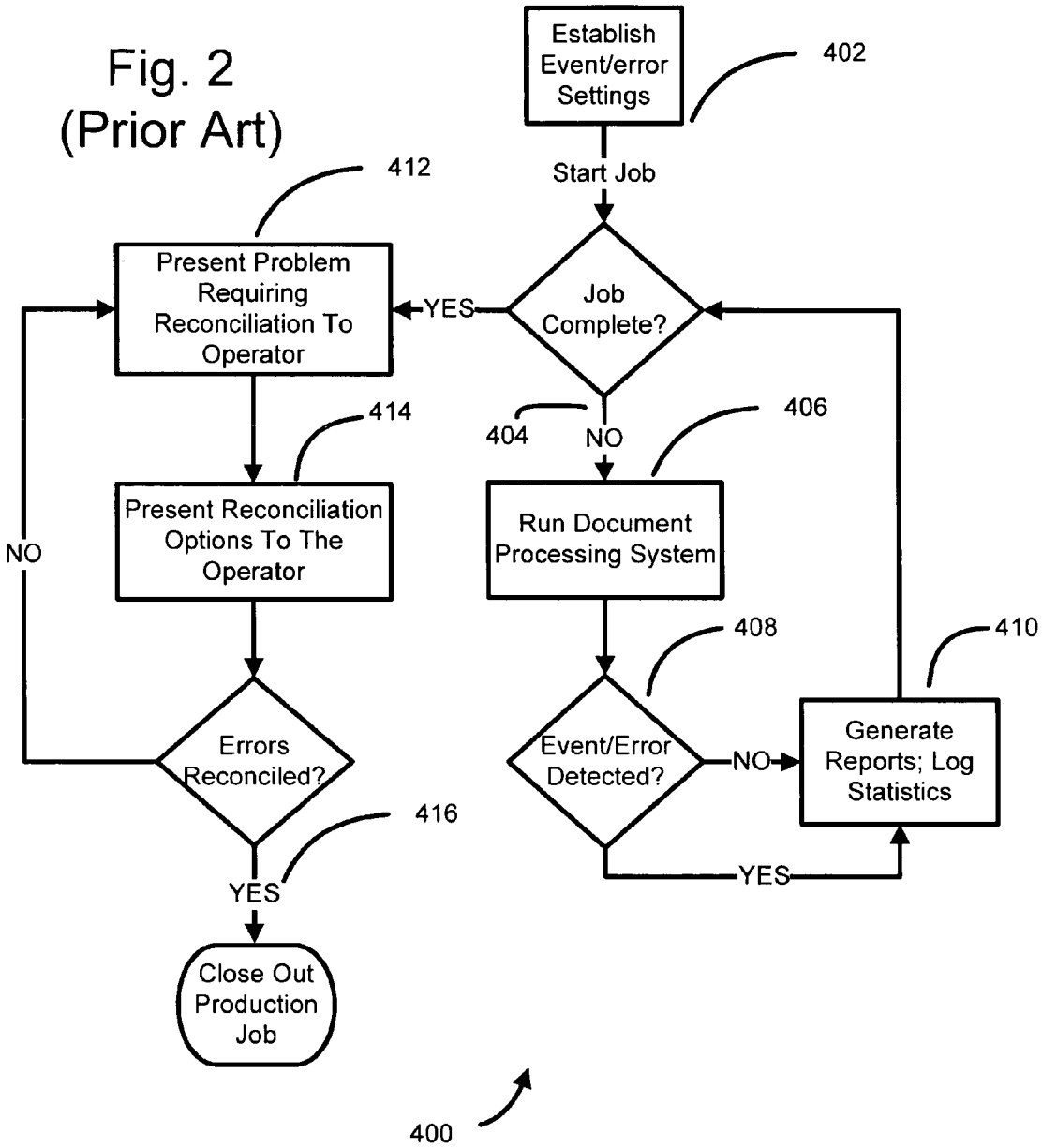
Fig. 2 (Prior Art)
FIG. 2 is a flowchart which illustrates a conventional post-job reconciliation process.
Figure 3:
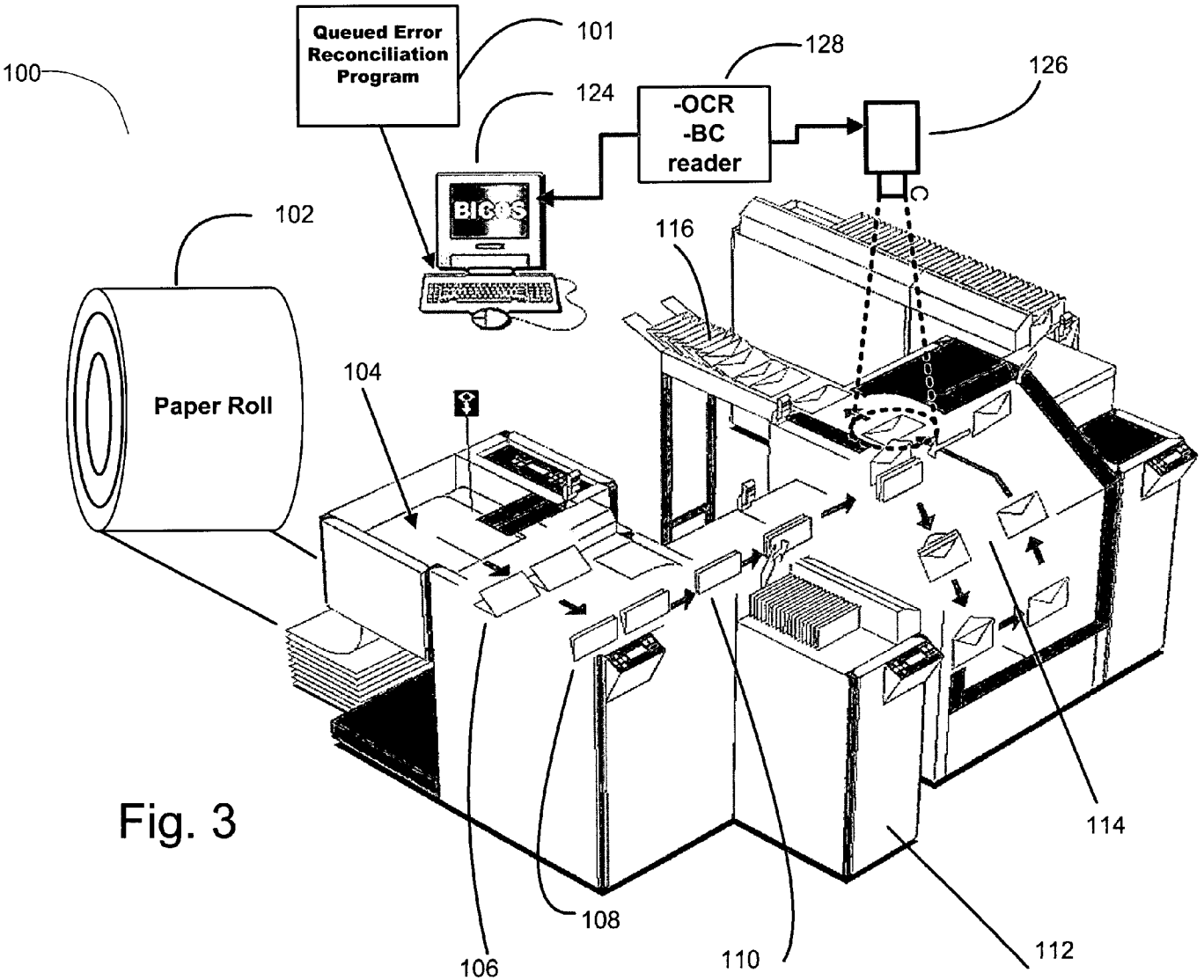
FIG. 3 depicts an exemplary document processing system programmed with a queing or logging type error reconciliation program.

FIG. 3 illustrates a document processing system programmed with a queued error reconciliation mail processing program 101. The document processing system for generating mail pieces, such as an inserter 100, is illustrated in FIG. 3. The inserter 100 may be comprised of a plurality of components or modules which are electrically and/or mechanically coupled to perform various document processing operations. A paper roll 102, generally having printed mail piece markings on it (e.g., text, barcodes, sequence numbers or graphics—printers not shown) is fed into a cutting module 104 for dividing the paper roll into individual sheets. These sheets, which may or may not be two-sided, are then passed on to a folding module 106 to be configured into single-fold, z-fold, or wrapped documents. Once they are folded, the documents are then placed into an accumulator (not shown), which combines pages from a multiple page a predetermined order for processing by a upright module 108, and assembled into the collation track 110. Once the documents are assembled, an insert feeder 112 may be provided for adding additional inserts or documents to the mail piece, and collating them for insertion into an envelope by an inserting station 114. Once the documents comprising the mail piece are inserted into the envelope and sealed, the document may then be passed onto an output transport device 116, where it may be further processed downstream (e.g., processed by one or more imaging devices, postage meters or stackers).

A marker system may be added before the transport device 116 for marking the mailpiece associated with an error. This will enable the operator to quickly locate the mailpieces with an error that needs to be reconciled. A common marking technique is to mark the edge of the mailpiece so that it is easily visible in a stack of mail even after it has been swept into a tray. Another option is for the operator to manually place a different mark on the piece once the error has been reconciled. As yet another technique, for sequence errors the mark is generally placed on the piece immediately preceding or following the detected sequence error. Other techniques for identifying error mailpieces can be implemented by those skilled in the art.

The document processing system 100 and its corresponding modules may be controlled by a computer system 124. The computer system 124 has numerous functions, some of which may include controlling the operation of each of the above described components of the document processing system 100, processing image data from the camera system 126 and providing an operator interface for control, setup, error reporting and overall machine operation. As illustrated herein, the computer 124 may be coupled to one or more imaging devices 126 such as an optical scanner, reader or camera. The imaging device 126 scans or images a mail piece, or at least the various address components on the mail piece, as it is processed at various stages of the job run by the mail processing system 100. While shown as a single imaging device 126 in the illustrated embodiment, the inserter 100 may employ a plurality of imaging devices in varying orientations for imaging or scanning mail pieces as they are processed through the inserter. Additional sensor types maybe added to detect magnetic ink, chemical composition or unique properties that enable positive recognition of a document or mail piece or detect flaws or errors in the finished mail. The computer system 124 may employ a graphical user interface for presenting captured images to an operator of the document processing system 100, and for processing various operator commands. It is important for those skilled in the art to recognize that while shown as a single computer 124, a network of computers could be employed to implement the relevant system data processing and/or control functions of the document processing system 100.

Typically, the imaging device 126 may be used in conjunction with an OCR or barcode reader utility 128 to allow for the recognition or tracking of mail pieces against recognized data records using optical character recognition (OCR) technology. OCR systems 128 include the optical scanner 126 for reading text, and sophisticated software for enabling the computer 124 to analyze images. Alternatively, the OCR system may include a combination of hardware (e.g., specialized circuit boards) and software to recognize characters, or can be executed entirely through software. Those skilled in the art will recognize that various OCR systems may be employed by the imaging device 126 and computer 124 for the purpose of recognizing a plurality of address components residing on the mail piece. The OCR system could be used for perceiving various markings on a mail piece, including but not limited to, trainable OCR fonts, sequence verification, barcodes and 2D symbologies, address masking detection, indicia print errors, images such as company logos, POSTNET barcode verification, etc. Advanced image processing is used to detect the presence of envelope spoilage by comparing the overall envelope to the expected image content. For example, additional lines are indicative of tears or smudges, which is further indicative of printing problems or physical damage. Such occurrences are detected as unexpected image content and trigger an error to the system.

Figure 4:
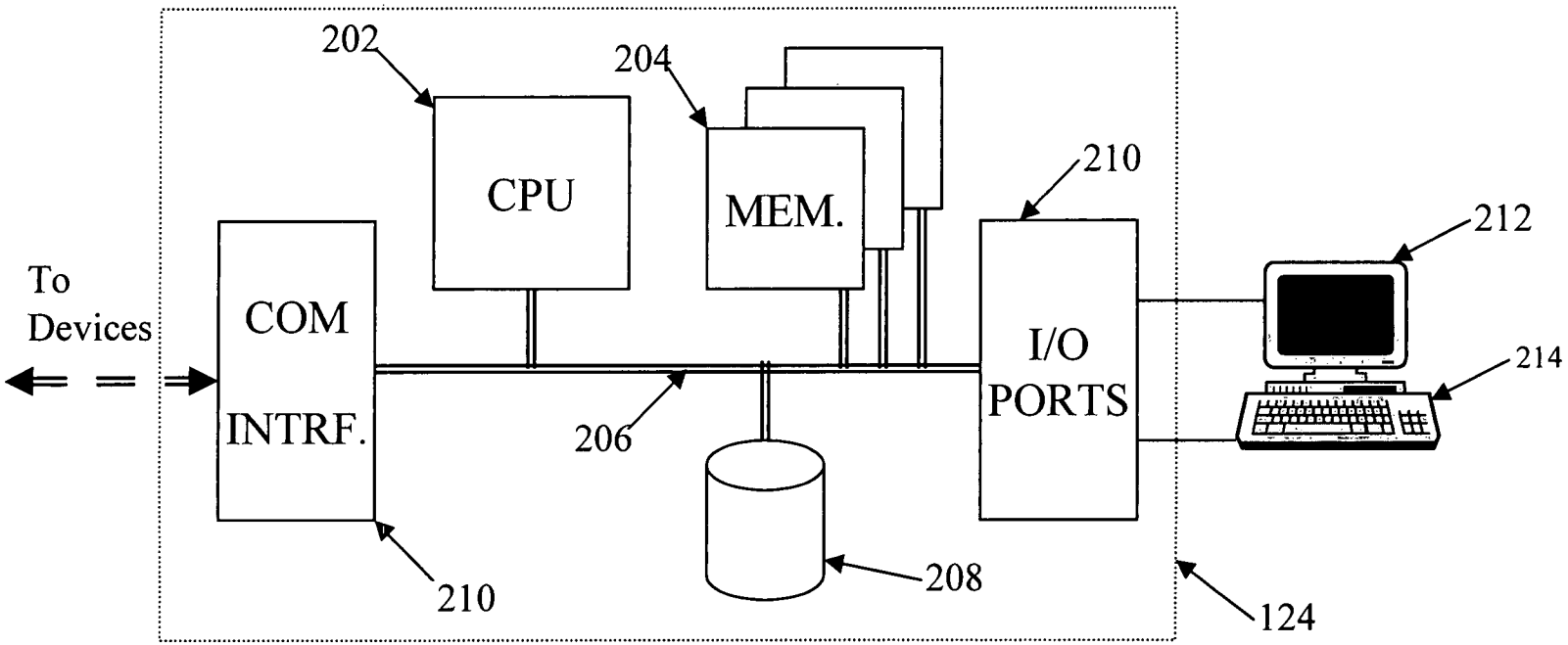
FIG. 4 depicts an exemplary computer programmed with the reconciliation process program used in conjunction with the document processing system in FIG. 3.

Computer system 124 may include a central processing unit (CPU) 202, memories 204, and an interconnect bus 206 (See FIG. 4). The CPU 202 may contain a single microprocessor, or may contain a plurality of microprocessors for configuring the computer system 124 as a multi-processor system. The memories 204 include a main memory, a read only memory, and mass storage devices such as various disk drives, tape drives, etc. The main memory typically includes dynamic random access memory (DRAM) and high-speed cache memory. In operation, the main memory stores at least portions of instructions for execution by the CPU 202 and data for processing in accord with the executed instructions.

The mass storage 208 may include one or more magnetic disk or tape drives or optical disk drives, for storing data and instructions for use by CPU 202. For a workstation PC, for example, at least one mass storage system 208 in the form of a disk drive or tape drive, stores the operating system and application software as well as a data file. The mass storage 208 within the computer system 124 may also include one or more drives for various portable media, such as a floppy disk, a compact disc read only memory (CD-ROM or DVD-ROM), or an integrated circuit non-volatile memory adapter (i.e. PC-MCIA adapter) to input and output data and code to and from the computer system 124.

The computer system 124 also includes one or more input/output interfaces 210 for communications, shown by way of example as an interface for data communications via a network or direct line connection. The interface may be a modem, an Ethernet card or any other appropriate data communications device. The physical communication links may be optical, wired, or wireless. The network or discrete interface may further connect to various electrical components of the document processing modules, discussed herein, to transmit instructions and receive information for control thereof. The network may be any type of communication implementation for receiving and transmitting information to and from components of the inserter and components external to the inserter.

As shown in FIG. 4, the computer system 124 may further include appropriate input/output ports for interconnection with a display 212 and a keyboard 214 serving as the respective user interface. For example, the computer system 124 may include a graphics subsystem to drive the output display. The output display may include a cathode ray tube (CRT) display or liquid crystal display (LCD). Although not shown, the PC type system typically would include a port for connection to a printer. The input control devices for such an implementation of the system would include the keyboard for inputting alphanumeric and other key information. The input control devices for the system may further include a cursor control device (not shown), such as a mouse, a trackball, a touchpad, stylus, or cursor direction keys. The links of the peripherals to the system may be wired connections or use wireless communications.

The computer system 124 shown and discussed is an example of a platform supporting processing and control functions of the document processing system described herein. The system control, queuing and reconciliation functions and the associated data processing operations discussed herein may reside on a single computer system, or two separate systems; or one or more of these functions may be distributed across a number of computers.

The software functionalities of the computer system 124 involve programming, including executable code as well as associated stored data. Software code is executable by the general-purpose computer 124 that functions as an inserter controller. In operation, the code and optionally the associated data records are stored within the general-purpose computer system 124. At other times, however, the software may be stored at other locations and/or transported for loading into the appropriate general-purpose computer system. Hence, the embodiments involve one or more software products in the form of one or more modules of code carried by at least one machine-readable medium. Execution of such code by a processor of the computer platform enables the platform to implement the control, queuing and reconciliation functions in essentially the manner performed in the embodiments discussed and illustrated herein.

Figure 5:
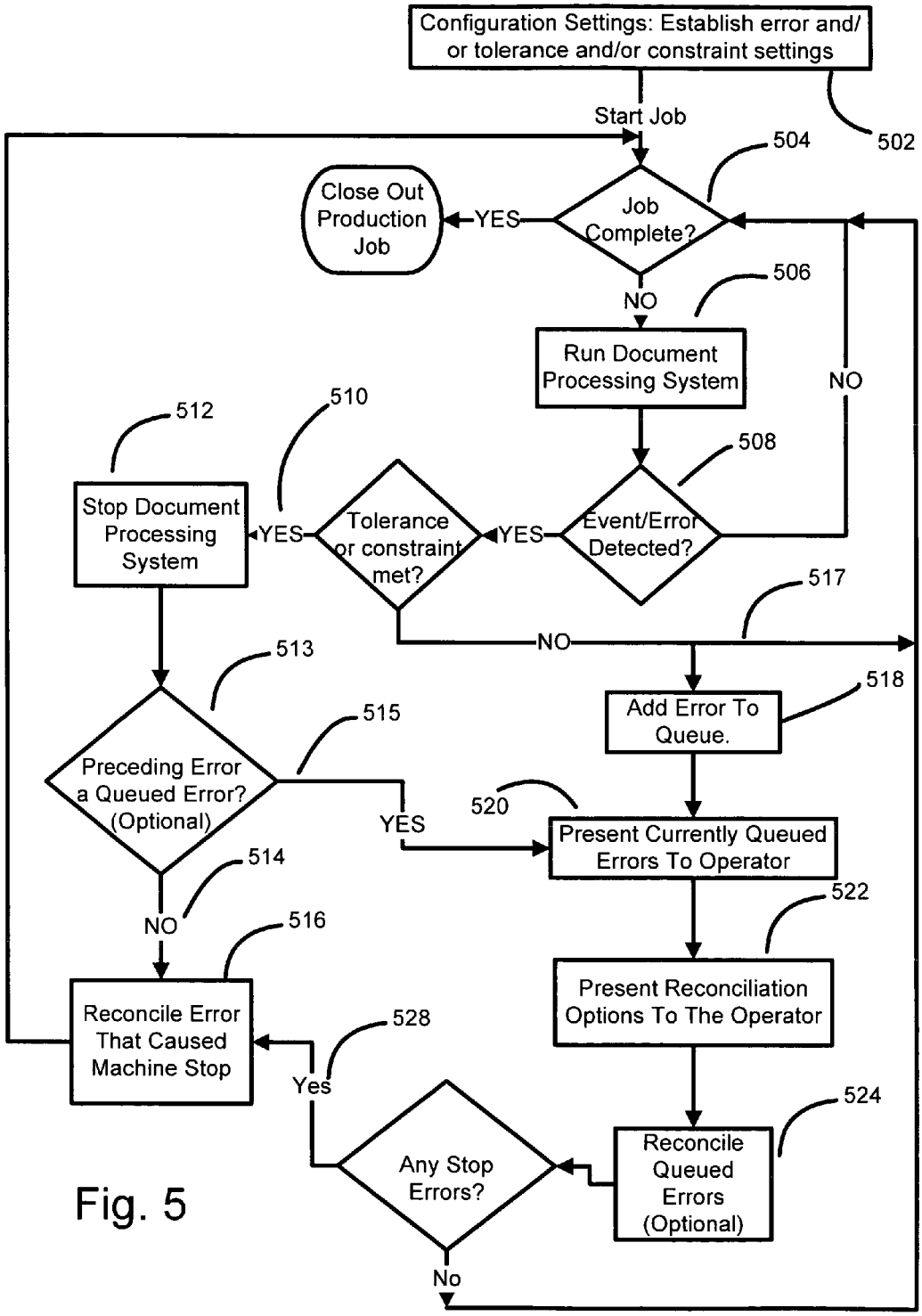
FIG. 5 is an exemplary flowchart which illustrates the error reconciliation process.

To address these issues, an exemplary concept for allowing errors to be queued as they occur and reconciled approximately concurrently with the execution of the document processing system—referred to as queued error reconciliation—is illustrated in FIG. 5. The terms queued and logged can be used somewhat interchangeably. All errors are entered into an error log, and they can be processed and resolved in the order received (similar to a queue), or the order of the errors in the log may be modified according to set rules to produce a new "queue" which may be adjusted as each new error condition is entered. These concepts are later explained in further detail. Error reconciliation in accordance with the present concepts allows errors not requiring complete system stoppage to be added to an error queue or log during the job run, and presented (e.g., as an error list) for reconciliation to the operator of the device—such as via a user friendly graphical interface—during continued processing of the job run. The machinery need not be stopped, and reconciliation need not always wait until the job run is otherwise complete. Hence, queued error reconciliation ensures that errors can be detected and in at least some cases reconciled concurrently during the operation of the inserter device or other document processing system. This maximizes the efficiency of the system by significantly reducing machine stops, enables faster full completion of a job run, and allows preventative measures to be identified and acted upon by the operator throughout the operation of the device among other advantages.

As shown in the exemplary flow chart (FIG. 5), firstly, various event triggers are established prior to the execution of the job run (event 502). Two specific types of errors may occur during operation of the system, namely queued errors and stop errors. Stop errors are errors wherein the document processing device is compelled to stop the operation of the job run. In general, stop errors are triggered when one or more conditions or events occur as defined by the mail processing facility or operator. These conditions or constraints are discussed further in later paragraphs of this description. Queued error settings refer to any events indicative of a mail processing error, such as document spoilage (e.g., a wrinkled or torn mail piece), sequence errors, indicia errors, address errors (e.g., wrong address applied to a known recipient), zip code or barcode errors, and any other address component errors which are detectable by an imaging or scanning device, and that do not necessarily result in a machine stop. In accordance with the examples presented herein, these types of errors would simply be added to a queue and presented for reconciliation at the appropriate time to the operator.

Those skilled in the art will recognize that various error settings may be established, and that the types of errors established as requiring reconciliation may vary from one mail facility to another or from one application or job to another. It is possible that one mail production facility may require that indicia visibility or application errors be identified when they occur, while another mail production facility may require the identification and flagging of improper barcode data. Indeed the list of potential errors that can be handled in a queued fashion is extensive and will change as quality standards evolve and sensor systems evolve. A few of the additional error types not included in the examples discussed below include read errors, no read, pre-sort error or incorrect ZIP-CODE data such as 9999 in the code. The examples described herein are not limited to any specific type of error that may occur during the execution of a job run.

In addition to error settings, tolerance settings may also be specified in conjunction with an error setting as a means of indicating the severity of one error versus another. As such, different tolerance settings being assigned to a specific error may affect the level of attention or sensitivity of the document processing system as queued errors occur. If so desired by the mail processing facility or operator, tolerance settings may be implemented to even trigger the complete stop of the document processing system and the job run (e.g., generate a stop error). So, for example, a mail facility may establish a numeric range of tolerance or sensitivity from 1 to 999, where the lower range value indicates lower tolerance and thus lower sensitivity to a particular error (e.g., to trigger a complete stop), while a higher number indicates higher tolerance (e.g., to queue the error). Alternatively, the mail facility may employ an alpha based ranking system, wherein a certain alpha or even alphanumeric tolerance setting corresponds to a certain error level. Various means of implementing the tolerance settings in regard to detected errors may be employed.

Suffice it to say the tolerance settings provide a means of error precedence and granularity that presents the mail processing facility with the ability to better decide how to reconcile errors as they occur and/or as they are presented to the display. In this scenario, the error can be presented along with the corresponding tolerance level of the error, such that the operator may better determine which errors to address first. Tolerance values versus error types also is used to set the priority or urgency associated with reconciling and clearing the error—resulting effectively in a means for dynamically stopping a job run. This is a particular advantage over conventional job run stop methods wherein machine stop errors are not based on priority, but rather are set as a hard stop (e.g., STOP or NO STOP, 0 or 1, high-edge or low-edge signal trigger, etc.).

As another means of triggering events during a job, constraints may also be implemented. A constraint represents a condition, be it operational or functional, that when met during the execution of the document processing system, triggers a predetermined response. Constraints are useful particularly for triggering the stoppage of high-speed inserter devices, where certain mail piece error conditions detected early on in the job run can aid in the prevention of loss of integrity of the entire run. So, for example, an inserter device may employ a time constraint of so many minutes or seconds, wherein if a queued error has not been reconciled within that time, a machine stop may occur. As another example, the inserter device may employ a pending error constraint, wherein if a set number of queued errors occurs, a machine stop may occur. Still further, in another example, the document processing system may employ a piece count constraint, wherein a predetermined number of pieces of mail contain an error as counted by the system or indicated by a jump in the sequence number indicates a significant production error requiring immediate action. Indeed, various other constraints may be implemented according to the specific application needs of the operator or mail processing facility.

Once the event settings are established, the production run is placed underway (events 504 and 506). If errors are detected (event 508), a determination must then be made as to whether the error is one requiring queuing or one requiring machine stoppage. When no constraints or tolerance settings have been triggered in connection with a detected error, then this error is added to the error queue (event 518). In concurrence with event 518, the operation of the document processing system is maintained as represented in the figure as event 517. Although the document processing system continues to run, the error is added to the queue 518 and presented to the operator 520 with reconciliation options 522. The operator has the choice to reconcile the error immediately as the job run continues to execute or allow it to stay in the queue 524 and address the errors at a later time during or after the execution of the job run. Since this error did not trigger a stop, step 526 will be a no and the job will continue. As stated earlier, this functionality is a significant distinction between the queued error reconciliation process and the prior art, wherein for the prior art systems, errors cannot be reconciled concurrently with the execution of a job run.

If, however, an error occurs that results in a particular tolerance or constraint setting being triggered (event 510), then a stop error is generated and the document processing system is stopped in its entirety (event 512). Next, a determination is made as to whether or not there are any queued errors already in the queue that are related to the stop error, and whether or not there are any configuration settings (e.g., constraints or tolerance settings) requiring certain types of queued errors to be reconciled during machine stoppage. In the event there are no queued errors requiring reconciliation prior to the triggering of the stop error (event 514), the stop error is reconciled first (event 516). The job run is then resumed upon the proper reconciliation of the stop error (event 504). Stop errors may include a significant jump in sequence numbers, excessive time since and error was logged and not resolved or based on the total number of errors in the error log that need to be resolved. Other error conditions may be included in the stop category. The stop error conditions are set generally based on a belief that whenever such a condition has developed the operator will not be able to resolve the error condition during the job run without significant risk to the quality of the mail being produced. Once a stop error is triggered the operator has sufficient time to resolve the reported errors. For example, the underlying cause of a large sequence number jump can be determined and corrected and the list of queued errors from the error log can be resolved before the mail is dispatched away from the document processing system.

On the other hand, if the error or errors that preceded the stop error was a queued error (e.g., an accumulation of queued errors) (event 515), then the queued errors preceding the detected stop error are presented to the operator (event 520), such as via a graphical user interface with various reconciliation options that the operator may employ (event 522). Once the queued errors are reconciled (event 524), the stop error is made available for reconciliation (event 526). The operator may be required to reconcile multiple queued errors before a stop error can be reconciled 529. If sufficient errors have not been reconciled 530, steps 520, 522, 524 and questions 526 and 529 will be repeated until sufficient queued errors have been reconciled. It is then possible to reconcile the stop error 516 and restart the system 506.

Of course, queued errors need not necessarily be addressed before addressing a stop error. In certain instances it is possible to allow the stop error to be addressed before any preceding queued errors without taking away from the novel concepts herein. As a matter of practicality though, stop errors generally signify a higher level of error priority than one simply requiring queuing. Hence, when queued errors cause or are related to a subsequent stop error, it is practical to rectify these errors before the stop error to ensure they do not result in more stop errors during later job run execution. Furthermore, addressing queued errors before a stop error prevents confusion during the job run in instances where a stop error occurs at the moment a queued error is being reconciled. As such, the stop error is not communicated to the operator via the graphical user interface until they are finished reconciling the current queued errors currently being presented, or they leave the queued error command screen.

Figure 6:
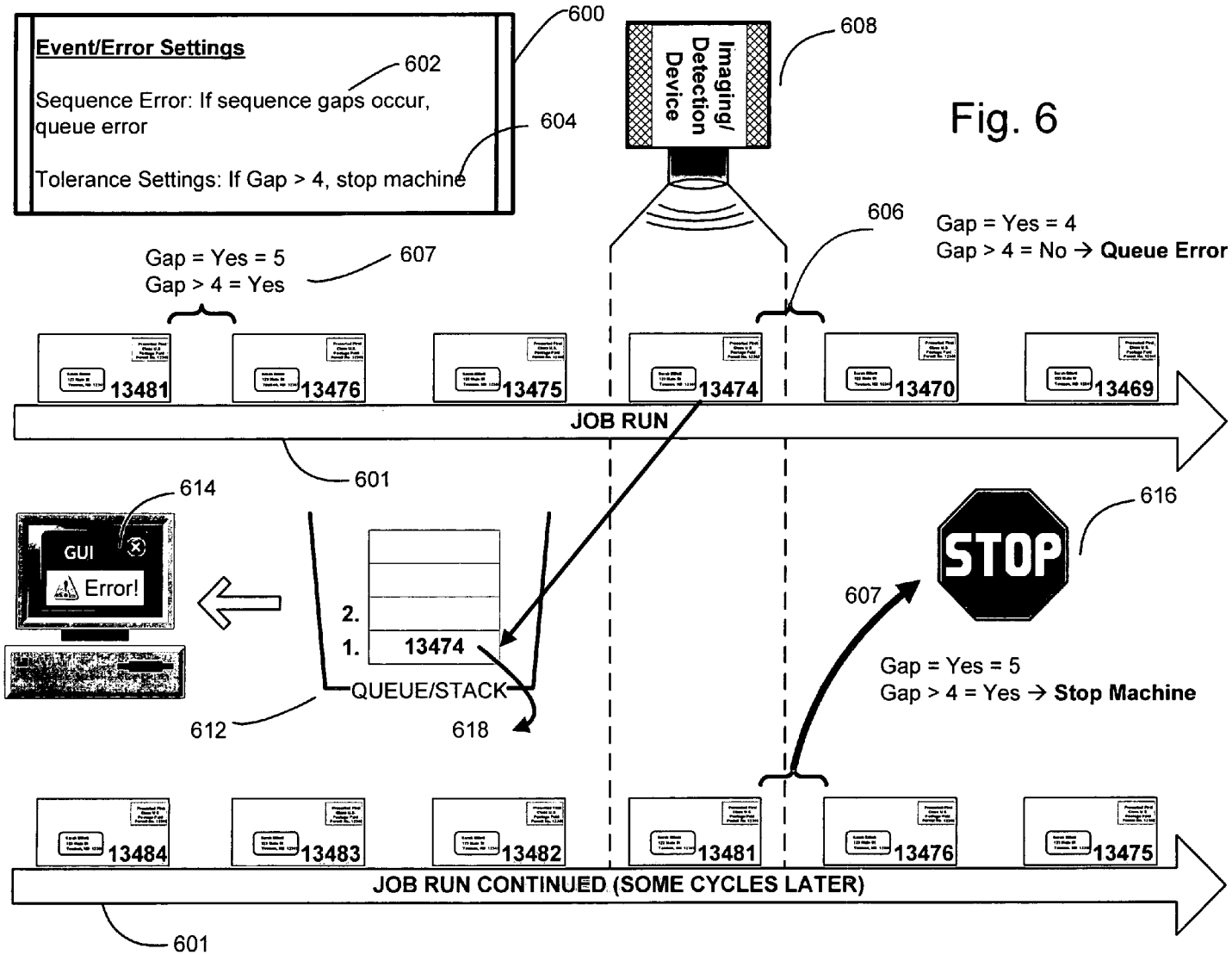
FIG. 6 is an exemplary depiction of error reconciliation mail processing for mail having various sequence errors and tolerance settings.

The queued error reconciliation process for sequence type errors is further described by way of example with respect to FIG. 6. In FIG. 6, a plurality of mail pieces having one or more sequence errors 606 and 607 are depicted as being processed along a production line 601 over time by an inserter (not shown). Sequence numbers are typically printed onto mail pieces as a means of verifying that a series of pieces are continuously produced during the job run. Gaps between mail pieces, such as in the case of sequence gaps 606 and 607, indicate missing pieces that must be accounted for in order to signify ultimate completion of a job run (e.g., were the missing pieces hand stuffed by the operator or perhaps diverted to another machine?). The process of accounting for errors that may occur during the job run is reconciliation in such an example. Sequence errors are detected by the document processing system operating in conjunction with the detection device 608 via the error settings 600, whereby the error settings allow distinctions to be made between those errors that are to be queued and those resulting in machine stops. In this example, sequence errors in general are identified for queuing 602 when they occur, while the tolerance settings are established such that a sequence error gap greater than four (4) in number triggers a machine stop 604.

Figure 11:
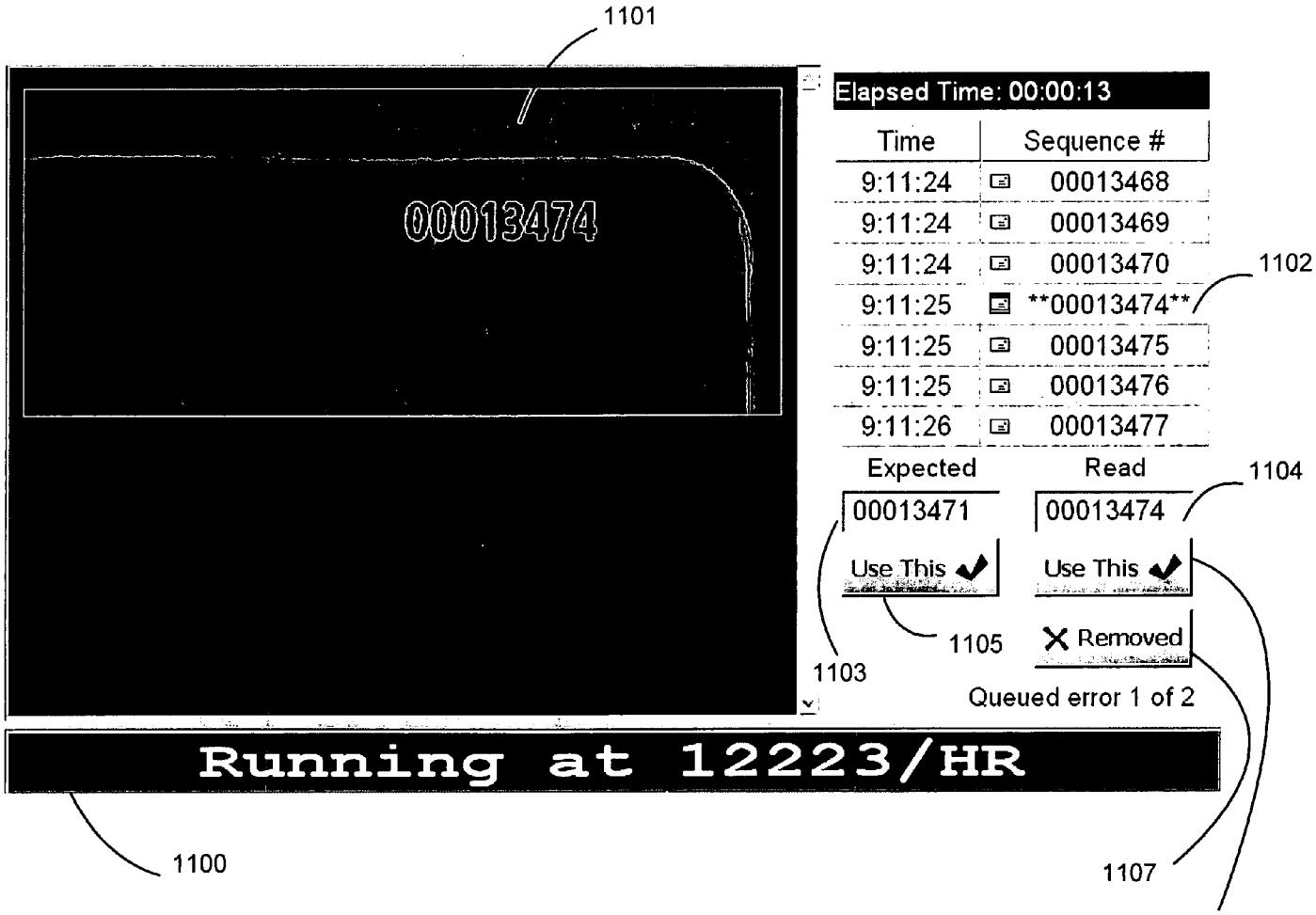
FIG. 11 is a depiction of a graphical user interface for presenting logged errors to the operator of the document processing system.
Figure 12:
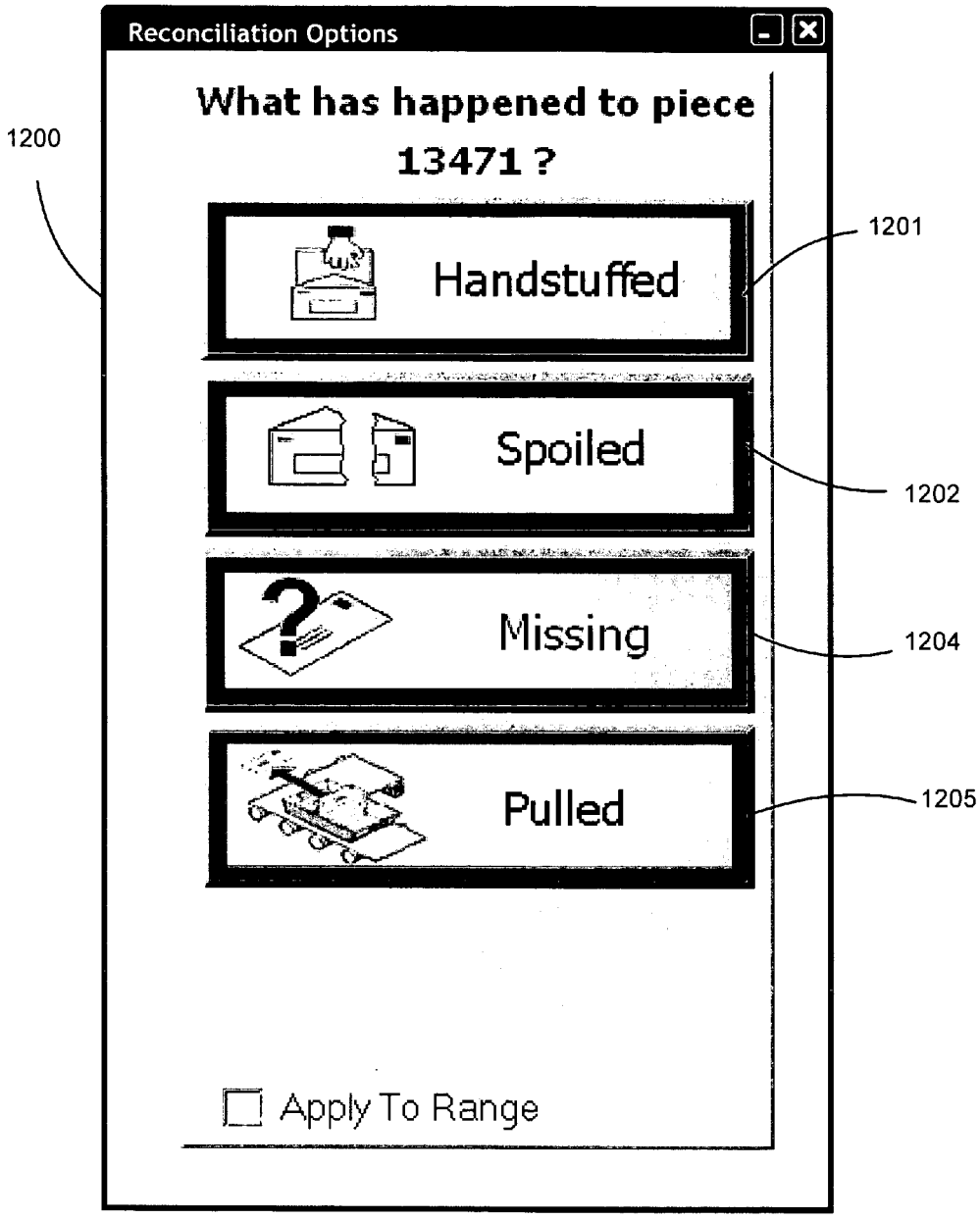
FIG. 12 is a depiction of a graphical user interface for presenting logged error reconciliation options to the operator of the document processing system.

In accordance with these settings, when the imaging or detection device 608 identifies the sequence error gap 606 between mail pieces 13474 and 13470 (event 508 of FIG. 5), the error is placed in the queue 612 (event 518 of FIG. 5) because the sequence gap is not greater than 4. The queued error is then presented to the operator's computer where the queue 612 is presented to the operator via a graphical user interface (GUI) 614 and subsequently a screen presenting one or more reconciliation options that the operator may invoke (events 520 and 522). Reference is made to FIGS. 11 and 12 for an example of reconciliation options that can be implemented while the document processing system is operating. As the job run 601, is continued a number of cycles later, a second sequence error gap 607 between mail pieces 13476 and 13481 is detected. However, this time the sequence gap is equal to five (5), which exceeds the tolerance threshold of four (4) established prior to the job run (or perhaps during the job run in some cases). This occurrence corresponds to event 510 of FIG. 5, resulting in a complete stopping of the machine 616 (event 512).

In this example of operation described above, the stop error is not presented for queuing along with error 618 corresponding to sequence gap 606, but rather may be presented to the operator via a separate interface window or screen specific to the addressing of stop errors. It should be noted however, that while the stop error is not necessarily presented for queuing herein, those skilled in the art may indeed implement such functionality. Moreover, such functionality could be easily implemented by those having skill in the art in accordance with the teachings presented with respect to FIGS. 5 & 6 without limiting the scope of the exemplary concepts described. Stop errors may indeed be presented for queuing along with queued errors if so desired by the operator or the mail facility, and may be desired depending on the unique application and processing requirements of the facility. Of course, while stop errors may be queued and presented to the operator's GUI along with queued errors, the job run would still not commence until the stop error was reconciled.

Figure 7:
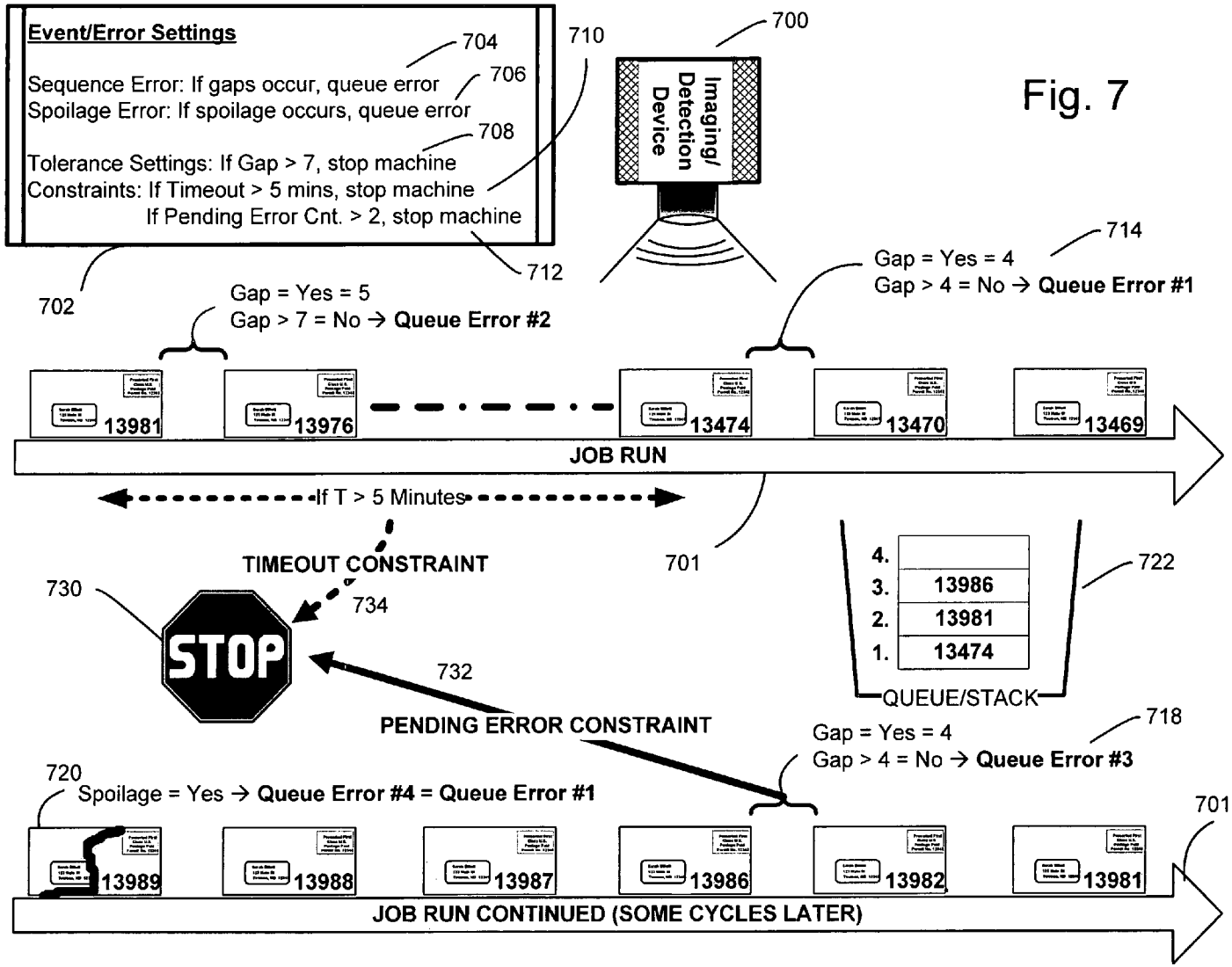
FIG. 7 is an exemplary depiction of error reconciliation mail processing for mail having various sequence errors, spoilage errors, tolerance setting and constraints.
Figure 8:
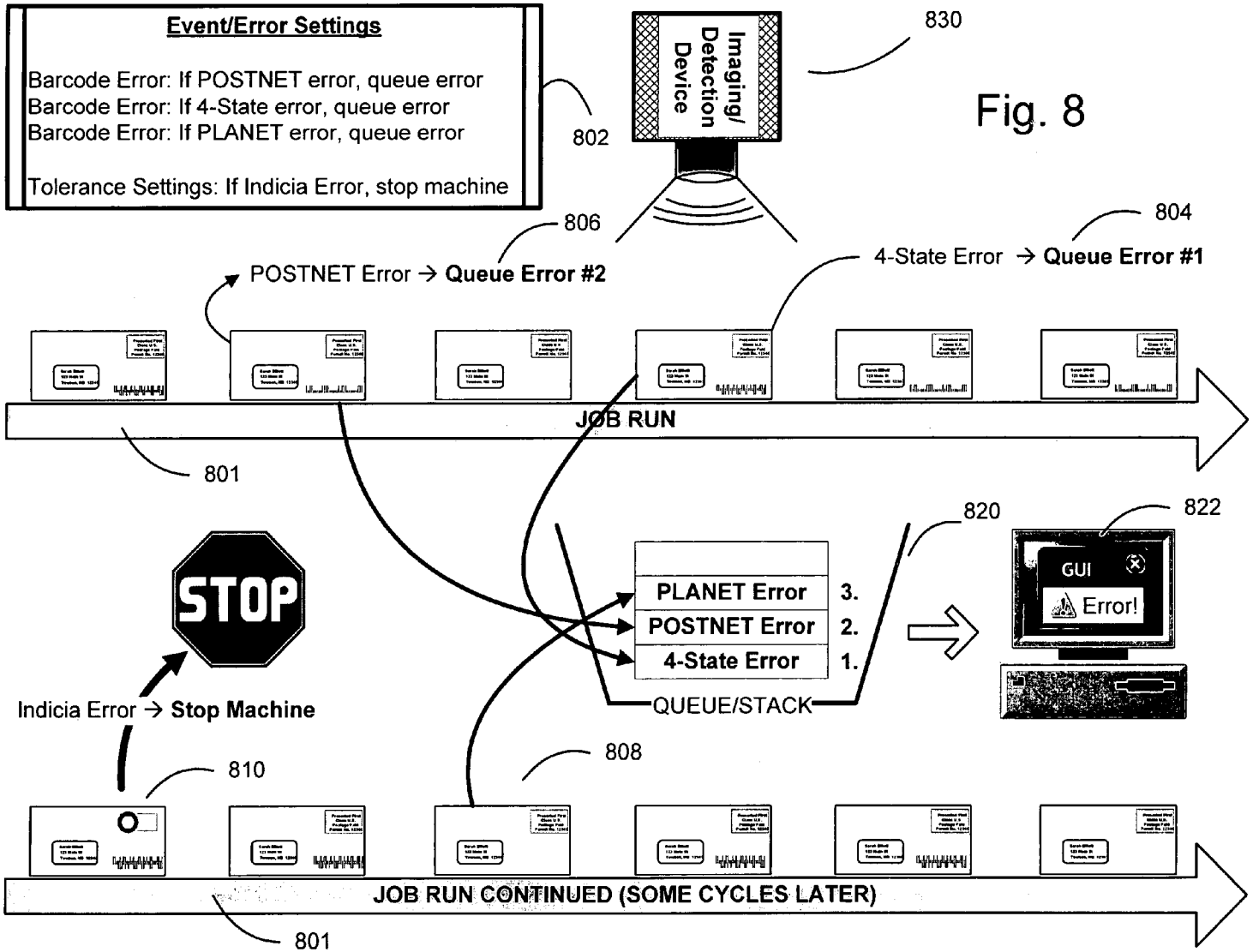
FIG. 8 is an exemplary depiction of error reconciliation mail processing for mail having address component and delivery point data errors.

Turning now to FIGS. 7 and 8, the queued error reconciliation process is further depicted by way of example with respect to other types of error occurrences. In particular, FIG. 7 depicts a job run in execution along several cycles under further event and error settings 702. In this example, sequence errors 704 and spoilage 706 errors are both established as requiring queuing upon being detected. Also, the tolerance threshold 708 with respect to the sequence error to invoke a stop error is seven (7). Still further, constraint settings 710 and 712 are provided to result in machine stoppage upon the occurrence of a specific timeout period or error count.

In accordance with these settings, sequence errors 714, 716 and 718 are added to the queue 722 as they are detected by the imaging and/or detection device 700. None of these sequence errors exceed the threshold of seven 708 required to result in the invocation of a stop error. However, a stop error 730 is invoked upon the occurrence of Queue Error #3 resulting from the pending error constraint 712 being met. As described previously, a pending error constraint occurs when a certain number of queued errors have accumulated during the execution of the job run 701 without being reconciled by the operator. Another stop error 734 that may occur during the execution of the job run 701 is one resulting from the timeout constraint 710 being met.

When the spoilage error (Queue Error #4) 720 is detected, it is added to the queue in accordance with the procedures described in FIG. 5 starting with event 513. Errors #1-#3, having occurred prior to the pending error constraint 732 being invoked, are reconciled first (event 515, and events 520-524), followed by the stop error (events 528 and 516). As a result, when the queued error is again presented to the operator, the previous errors 714, 716 and 718 would no longer be listed, and the spoilage error 720 would be in a first to reconcile position within the queue—corresponding to a first-in-first-out (FIFO) stack accumulation process. Alternatively, other stack accumulation processes such as last-in-first-out (LIFO) may be implemented to account for varying error reconciliation needs (e.g., operator or mail processing facility prefers to reconcile the most recent queued error first as opposed to those which may have already been transported downstream within the inserter). Alternatively, the event/error settings 702 are prioritized based on their significance to completing a successful job processing run. Based on their priority, the queued error will be moved up or down in the FIFO or LIFO stack. The concepts herein are not limited to any specific stack or queue accumulation scheme.

In FIG. 8, various mail pieces having differing barcode or indicia designations are processed during the job run 801. Within this group of mailings are various mail pieces having errors resulting from erroneous address components being indicated on the mail piece, such as improper barcodes. These errors are represented as errors 804, 806, 808 and 810. As before, what determines how an error is perceived and how the document processing system and/or job run is to respond errors as they are detected by the imaging or detection device 830 are the errors settings 802. In this case, settings 802 are configured to allow barcode errors (e.g., POSTNET, 4-STATE, PLANET) to be queued for reconciliation upon detection, while indicia errors result in stop errors (e.g., lesser tolerance setting). Barcode errors may occur as a result of print quality or format errors that do not meet postal standards, such as bar height or spacing or format errors such as incorrect check sum character. As the queued errors are identified, they are added to the queue 820 and subsequently presented to the operator's GUI 822 for reconciliation as the job run continues. Reference is made to FIGS. 11 and 12 for an example of reconciliation options that can be implemented while the document processing system is operating. The operator then has the opportunity of reconciling the errors at that time, or delaying reconciliation until a later time (all queued errors must be reconciled to signify completion of the job run). However, when the stop error 810 results in a complete machine stoppage, such errors must be reconciled immediately for further job run execution. Alternately, the critical error of no indicia 810 can be queued as a top priority to be resolved by the operator before any other queued errors and within a very short period of time. The priority settings would be programmed into the Event/Error Settings 802. For this example, a second occurrence of this error would result in a machine stop.

While FIGS. 6, 7 and 8 present some of the errors, tolerances, priority levels and constraints that may occur during a job run, the exemplary queued error reconciliation process described herein is not limited to only the errors depicted. Indeed, numerous error types may be queued for reconciliation, including those error types which are uniquely defined by the operator or mail processing facility. For instance, a marketing mail processing facility may utilize a special image on envelopes designated for prospects, while another image is used for existing customers. If the detection device (e.g., reader) detects an address block for an existing customer that is printed onto an envelope having an image meant for a prospect, this error can be queued for reconciliation by the operator. Essentially, any errors resulting from the improper application of any human or machine-readable markings or address components—images, barcodes, address lines, keyline data, etc.—may be queued. Also, while the description above makes reference to LIFO and FIFO stack processing, those skilled in the art will recognize that other means of stack or queue processing may be employed for building the error queue described herein. In particular, such a means of queued error processing is illustrated by way of example with respect to FIG. 9.

Figure 9:
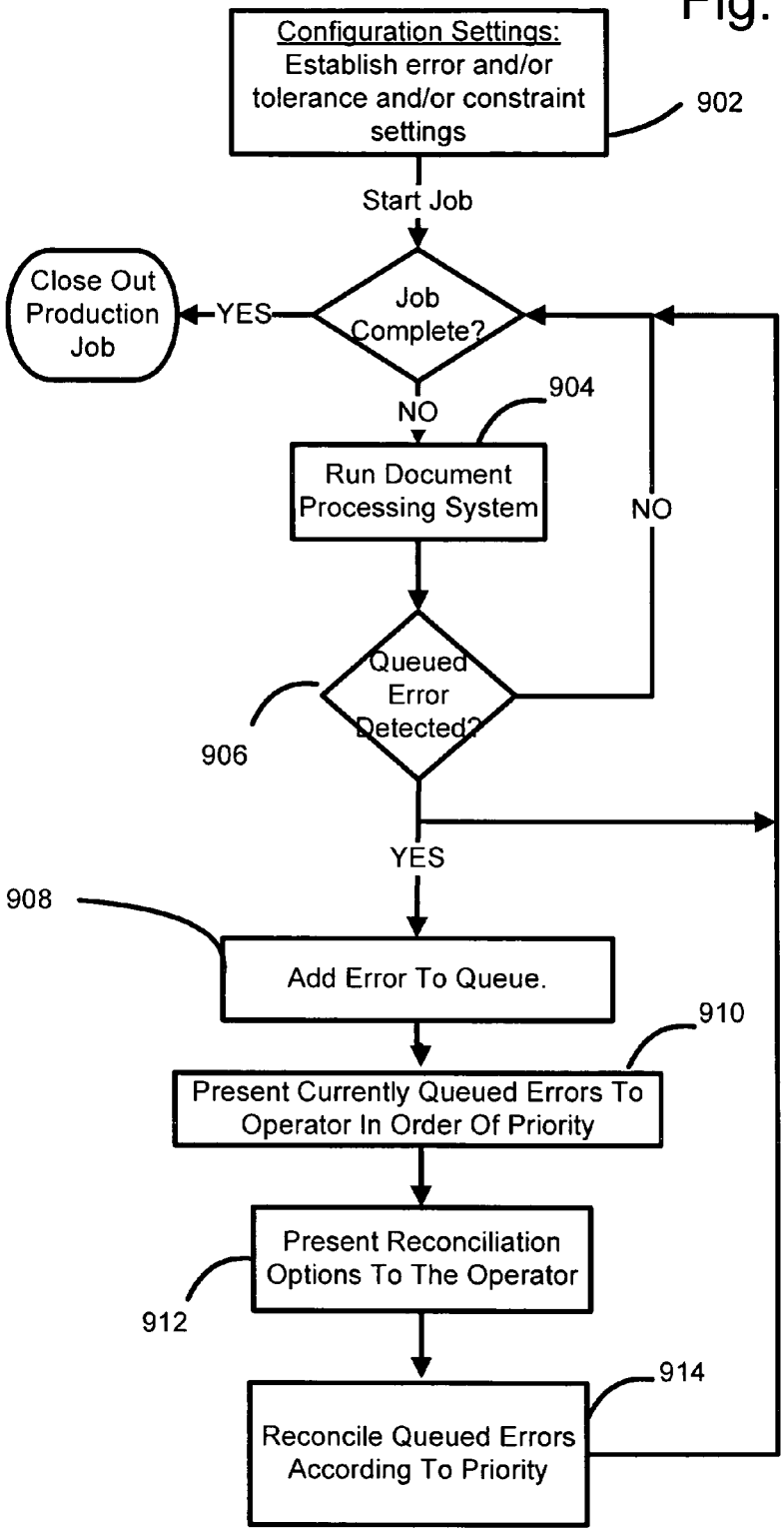
FIG. 9 is an exemplary flowchart which illustrates error reconciliation with prioritization.

FIG. 9 is an exemplary flowchart depicting the general queued error reconciliation process with prioritization. As in FIG. 5, configuration settings are established (event 902), and the job run is executed (event 904). As queued errors are detected (event 906), the execution of the mail processing device is continued and the error is added to the queue (event 908). When the queued errors are presented to the operator (event 910), however, they are presented in order of priority rather than according to a specific stack processing scheme (event 912). Priority may be established in various ways, such as according to a specific tolerance setting (e.g., tolerance 1-999) applied to a particular error occurrence, or based upon the occurrence of a particular constraint. As a result, queued errors are reconciled based on order of priority (event 914).

Figure 10:
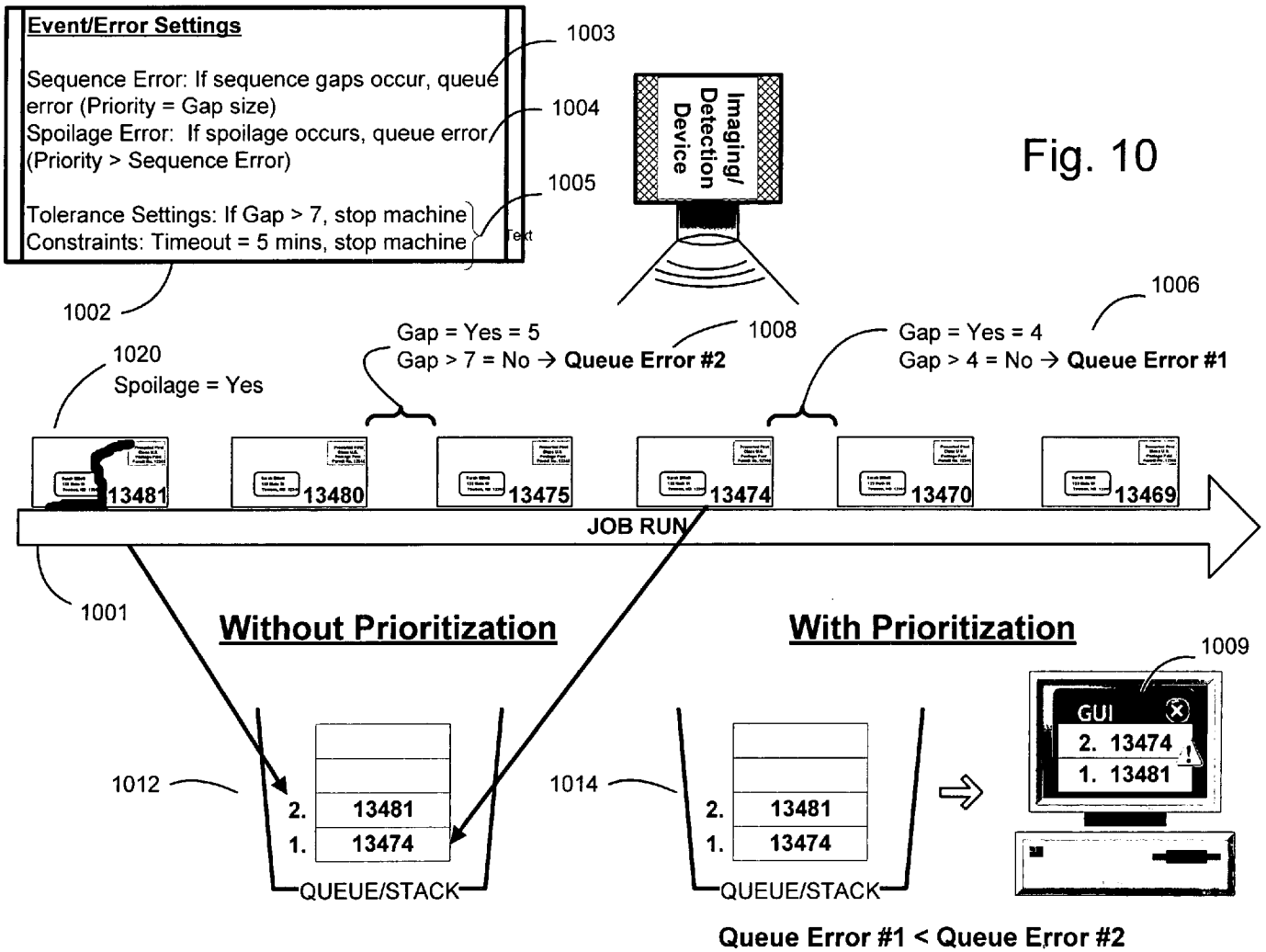
FIG. 10 is an exemplary depiction of prioritized error reconciliation mail processing for mail having various sequence errors, tolerance settings, and constraints.

FIG. 10 provides an example of queued error reconciliation with prioritization with reference to a job run 1001 for processing a plurality of mail pieces. The tolerance and constraint settings 1005 are defined as normal in accordance with the requirements of the operator or mail processing facility. Likewise, the configuration settings 1002 are defined as normal to establish what triggers a stop queue error, which in this case is a sequence error and spoilage error. However, in this case, the sequence error and spoilage error are assigned to a specific priority: priority is determined by sequence gap size for sequence errors, while spoilage errors are assigned as having a higher priority than the sequence errors. Alternatively, various tolerance settings may be assigned to the error as a means of allowing error priority differentiation. Regardless of how priority is set, allowing for errors to be assigned to a specific level of priority assignment affects how the errors are presented for reconciliation.

Where prioritization is not involved, the operation of the document processing system as described in previous sections of the detailed description is employed. Before prioritization 1010 as the job run 1001 is executed Queue Error #1 1006 gets added to the queue in a first queue position, followed by Queue Error #2 1008 in a second queue position. However, for queued error reconciliation with prioritization, the machine stop error with the largest sequence gap is presented for queue up first corresponding to the configuration settings 1002 (e.g., the greater the gap, the higher the priority). Hence, error 1008, having a sequence gap of 5 as compared to a 4 for error 1006, is the first error to be presented for queuing—illustrated as the prioritized GUI 1009. In instances where the gaps are equal, the queue is then accumulated on a FIFO basis or the like. Accordingly, various reconciliation options are presented to the operator (event 912) and are reconciled according to or in order of priority (event 914).

Notice that the queue stack without prioritization 1012 is equivalent to the queue stack with prioritization 1014. This is meant to indicate that while the errors may be presented in a prioritized fashion according to queued error reconciliation with prioritization, the stack or queue need not be accumulated by priority (but can be implemented as such if desired by one skilled in the art). Still further, a spoilage error 1020 occurs in mail piece 13481, which assuming that errors 13474 (1006) and 13480 (1008) haven't already been reconciled, mail piece 13481 (1020) would be presented for queuing first. This is due to priority setting 1004, wherein spoilage errors take precedence over sequence errors. Again, the queue can be accumulated by priority, or simply presented by priority.

In FIGS. 11 and 12, exemplary screen shots for presenting errors and reconciliation options to a graphical user interface are shown. With respect to FIG. 11, an imaged mail piece having sequence number 13474 is shown on the left side of the screen 1100. To the right side of the screen is history data relating to the queued mail piece 13474 such as time and sequence numbers (shown as 1102), as well as data pertaining to the mail pieces surrounding the queued mail piece 1102. Just below this range of data are data fields for indicating a sequence number that was expected to be read by the detection or imaging device versus that which was actually read. In addition, the operator is presented with various reconciliation options, namely a button 1105 for indicating that the expected piece is to be used in place of the read piece, and buttons for allowing the read piece to be accepted 1106 or removed 1107. The presentation of queued errors and reconciliation options corresponds to events 520 and 522 in FIG. 5, and would apply to events 1110 and 1112 where prioritization is applied. Further reconciliation options are shown in FIG. 11.

In FIG. 12, a reconciliation options interface screen 1200 is shown having several reconciliation options for the operator to consider. The four (4) operator reconciliation options shown in FIG. 12 include, but are not limited to: reconcile by indicating the missing mail piece was manually stuffed and placed in the correct mail tray 1201, reconcile by indicating the mail piece was spoiled 1202 (re-print may be ordered), reconcile by indicating that the mail piece is missing 1204, and reconcile by indicating that the mail piece was pulled or diverted from the job run 1205. While this does not cover the full gambit of reconciliation options, these are examples of some that may be applied for reconciling sequence errors specifically. For instance, if the customer does reprints to reconcile missing pieces, a reprint button could be added to the interface, or could simply be reconciled as a spoiled piece. Additional mail quality analysis may be added which would yield additional errors that can be queued. For example, POSTNET barcode conformance to postal standards, print contrast, address accuracy and other parameters identifiable on the mail piece. Most of these error would fall into the category of errors that need to exceed a threshold before corrective action is required which may include stopping the system.

In general there are three categories that a piece may fall into: 1) the piece was spoiled, 2) the piece is missing, and 3) the piece was intentionally pulled from the job. First, if the piece was spoiled (usually for a system fault such as a jam), the contents may not be damaged. In this case, the piece can be handstuffed into another envelope and manually placed in the correct mail tray. In this case, the "Handstuffed" option 1201 is selected. If the contents are damaged, then the piece must be reprinted and added to the mailing at a later time. Often this piece will not be dispatched with the rest of the mail in the current job run. In this case, the "Spoiled" option 1202 is selected. In the second situation, the piece is missing and the operator does not know where the piece is located. In this case, the "Missing" option 1204 is selected. In the third category, the piece was intentionally pulled from the job. The piece may have been pulled prior to the inserting process or diverted into a reject bin. It is possible the piece is a good piece but it was rejected due to overweight or because it was foreign mail. In this case, the "pulled" option 1205 is selected. While not shown in the figure, it is also possible that the various reconciliation options presented could be broken into further subcategories to allow for more specific reconciliation options. For example, the Pulled reconciliation option 1205 could include further subcategories such as (i) dunning notice cancelled, (ii) Foreign Divert, (iii) Overweight divert, and (iv) Other divert.

As a further means of implementation, it should be recognized by those skilled in the art that the reconciliation options presented herein are exemplary in nature only, and are not meant to be take as representative of all reconciliation options exercisable within the scope of the teachings herein. Several options may exist for reconciling a mail piece during a job run, and may vary from one application or processing environment to the next. For instance, some mail processing facilities may employ and present specialized or custom reconciliation options to the operator, i.e., options R1 (Reject1) through R9 (Reject) wherein the customer defines what each option means.

Those skilled in the art will recognize that the graphical user interface screen shots presented in FIGS. 11 and 12 are exemplary in nature only, and that various means of presenting data to an interface exist in the art. Furthermore, it will be easily recognized by those skilled in the art that FIGS. 11 and 12 are depictions of queued error reconciliation with respect to sequence errors, and therefore not meant to be representative of the types of information that may be presented for all errors. Rather, the GUI or screenshots may be adapted accordingly by one skilled in the art to accommodate the various types of errors that may be detected during the job run according the novel techniques and examples presented herein.

As used herein, terms such as computer or machine "readable medium" refer to any medium bearing the code or instruction that may participate in providing instructions to a processor for execution, for example, the instructions of reconciliation program 101 (FIG. 3). Such a medium may take many forms, including but not limited to, non-volatile media, volatile media, and transmission media. Non-volatile media include, for example, optical or magnetic disks, such as any of the storage devices in any computer(s) operating as one of the server platform, discussed above. Volatile media include dynamic memory, such as main memory of such a computer platform. Physical transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include, for example: a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the previous description, numerous specific details are set forth, such as specific materials, structures, processes, etc., in order to provide a better understanding of the present subject matter. However, the present subject matter can be practiced without resorting to the details specifically set forth herein. In other instances, well-known processing techniques and structures have not been described in order not to unnecessarily obscure the present subject matter.

Only the preferred embodiments of the present subject matter and but a few examples of its versatility are shown and described in the present disclosure. It is to be understood that the present subject matter is capable of use in various other combinations and environments and is susceptible of changes and/or modifications within the scope of the inventive concept as expressed herein.

What is claimed is:

1. A method for reconciling one or more errors that occur during execution of a job run of a plurality of mail pieces processed by a mail inserting system, the method comprising steps of:

setting an error configuration into the mail inserting system, the error configuration including a stop error which requires the mail inserting system to stop the job run and a queued error which does not require the mail inserting system to stop the job run;

starting the job run on the mail inserting system;

obtaining images of at least a part of each of the mail pieces by using an image detecting device;

detecting one or more instances of the stop error and the queued error based on analysis of the obtained images;

upon detecting the queued error:

recording instances of the queued error to a list during the job run;

displaying the list during the execution of the job run on a display;

displaying one or more reconciliation options in connection with the queued error on the display, at least one reconciliation option being executable without stoppage of the job run; and upon detecting the stop error, stopping the job run, wherein:

the step of setting an error configuration further includes, before starting the job run, setting a tolerance setting with a numerical range, which is used to convert a detected queued error or a plurality of queued errors into a stop error, and the tolerance setting is set based on a number of pending queued errors or a mail piece count of mail pieces containing errors.

2. The method of claim 1, further comprising:

when the stop error is detected, determining whether any queued errors have been recorded in the list, and when at least one queued error has been recorded in the list, displaying the list.

3. The method of claim 1, further comprising:

setting an order of priority of the queued errors, wherein the list is displayed by the display according to the order of priority of the queued errors.

4. The method of claim 3, wherein the one or more reconciliation options are displayed by the display device according to the order of priority of the one or more errors.

5. The method of claim 1, wherein the queued error is at least one of an error in a sequence number, an excessive mail piece gap, a barcode error, an indicia error, an address error or mail piece damage.

6. A system for reconciling one or more errors that occur during execution of a job run of a plurality of mail pieces processed by a mail inserting system, the system comprising:

a setting device for setting a configuration, the configuration comprising an error configuration including a stop error which requires the mail inserting system to stop the job run and a queued error which does not require the mail inserting system to stop the job run, the configuration further comprising tolerance setting information having a numerical range, which is used to convert a detected queued error or series of queued errors into a stop error and is set based on a number of pending queued errors, or a mail piece count of mail pieces containing errors;

a detection device comprising an image detecting device for detecting the queued and stop errors;

a log for recording the queued and stop errors detected by the detection device;

a graphical user interface for:

displaying the queued error detected during execution of the job run; and displaying one or more reconciliation options related to the queued error, at least one reconciliation option being executable without stoppage of the job run on the mail inserting system; and a controller for controlling the job run to be stopped upon detection of the stop error by the detection device.

7. The system of claim 6, wherein the configuration further comprises a priority configuration including an order of priority for queued errors, and the graphical user interface displays queued errors detected by the detecting device according to the order of priority.

8. The system for claim 6, wherein the queued error is at least one of an error in a sequence number, an excessive mail piece gap, a barcode error, an indicia error, an address error or mail piece damage.

9. A process for reconciling errors during execution of a job run of a plurality of mail pieces processed by using a mail inserting system, the process comprising steps of:

setting a configuration setting into the mail inserting system;

detecting, by using an image detecting device, an error as it occurs during the execution of the job run;

evaluating the error against the configuration setting;

displaying on a graphical user interface the occurrence of the error based on the configuration setting during the execution of the job run; and enabling the error to be reconciled without any stopping of the job run on the mail inserting system, wherein the configuration includes tolerance setting information having a numerical range, which defines whether the detected error or series of the detected errors are reconciled without any stopping of the job run or result in stopping of the job run and is set based on a number of pending queued errors or a mail piece count of mail pieces containing errors.

10. The process of claim 9, wherein the configuration setting comprises an error setting corresponding to a queued error which does not required the mail inserting system to be stopped.

11. The process of claim 9, wherein the configuration setting comprises a tolerance setting that is variable within a specified range so as to be associated with error settings to indicate a level of priority for the occurrence of the error.

12. The process of claim 9, wherein the step of displaying further comprises presenting the error in an order corresponding to its respective level of priority.

13. The process of claim 9, wherein the step of enabling further comprises presenting one or more options for reconciling the error.

14. The process of claim 9, wherein the queued error is at least one of an error in a sequence number, an excessive mail piece gap, a barcode error, an indicia error, an address error or mail piece damage.

15. A method for prioritizing errors to be reconciled during a job run of a plurality of mail pieces executed on a mail inserting system, the method comprising steps of:

setting a predetermined range for a tolerance setting with a numerical range into the mail inserting system before executing the job run, the tolerance setting being set based on a number of pending queued errors or a mail piece count of mail pieces containing errors;

associating a tolerance setting of a specific value within the predetermined range with one or more errors to indicate a level of priority for the one or more errors; and displaying on a graphical user interface a list of the one or more errors that occur during the execution of the job run while the mail inserting system continues executing the job run together with the associated tolerance setting, wherein the one or more errors are detected by using an image detecting device during the execution of the job run.

16. The method of claim 15, further comprising steps of:

identifying the one or more errors during the execution of the job run; and continuing the execution of the mail inserting system upon the occurrence of the one or more errors, wherein the one or more errors are associated with a tolerance setting that does not result in the stopping of the mail inserting system.

17. The method of claim 16, wherein the step of displaying the list of the one or more errors includes displaying the list of errors based on a level of priority.

18. A method for stopping a mail inserting system executing a job run of a plurality of mail pieces, the method comprising steps of:

setting into the mail inserting system a constraint setting associated with an error, the constraint setting including a numerical range of constraint before executing the job run;

detecting the occurrence of the error by using an image detecting device during executing the job run; and if a detected error falls in the range of the constraint setting, stopping the mail inserting system based upon the constraint setting, wherein the range in the constraint setting is set based on a number of pending queued errors or a mail piece count of mail pieces containing errors.

* * * * *